US007797959B2

(12) United States Patent
Amari et al.

(10) Patent No.: US 7,797,959 B2
(45) Date of Patent: Sep. 21, 2010

(54) OPEN SHOWCASE

(75) Inventors: Youichi Amari, Ota (JP); Shouichi Kanai, Gunam-ken (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 299 days.

(21) Appl. No.: 11/727,699

(22) Filed: Mar. 28, 2007

(65) Prior Publication Data

US 2007/0227169 A1 Oct. 4, 2007

(30) Foreign Application Priority Data

Mar. 29, 2006 (JP) ..... 2006-090890

(51) Int. Cl.
*A47F 3/04* (2006.01)

(52) U.S. Cl. ..... 62/256

(58) Field of Classification Search ..... 62/256, 62/285, 426

See application file for complete search history.

(56) References Cited

U.S. PATENT DOCUMENTS 4,914,928 A * 4/1990 Fellwock et al. ..... 62/408
5,357,767 A * 10/1994 Roberts ..... 62/256
5,761,922 A * 6/1998 Tamai et al. ..... 62/256

FOREIGN PATENT DOCUMENTS

JP 05-306871 * 11/1993
JP 10-205970 * 8/1998

* cited by examiner

*Primary Examiner*—Frantz F. Jules
*Assistant Examiner*—Emmanuel Duke
(74) *Attorney, Agent, or Firm*—Kratz, Quintos & Hanson, LLP

(57) ABSTRACT

There is provided an open showcase which enables elimination of the drawback that a cooling air rising in an inner layer duct leaks out to an outer layer outlet side from between a partitioning member and a partition wall. The open showcase has a partitioning member which is mounted to the partition wall at a position between the outer layer outlet and the inner layer outlet and extends downward from the partition, and an upstanding wall formed by folding the front edge of the partition wall. The partitioning member has an engagement part to be engaged with the top edge of the upstanding wall from the front side and a fixing part closely contacting the bottom surface of the front part of the partition wall continuing to the upstanding wall when the engagement part is engaged with the top edge of the upstanding wall. The fixing part is fixed to the partition wall with a screw with the fixing part closely contacting the partition wall.

2 Claims, 4 Drawing Sheets

OPEN SHOWCASE

BACKGROUND OF THE INVENTION

The present invention relates to an open showcase having a front opening formed for putting in and taking out goods and closed with a cooling air flow and a protection air flow.

Conventionally, this type of an open showcase comprises, as shown in Japanese Patent Application Laid-open No. 5-306871, a heat insulating wall, an inner wall in the heat insulating wall, and a partition wall to form an outer layer duct where the protection air flows and an inner layer duct where the cooling air flows, so that the protection air and the cooling air blow out from their respective outlets formed in the upper edge of the opening of the heat insulating wall to the front opening of the heat insulating wall so as to generate a protection air curtain formed with the protection air flow and a cooling air curtain formed with the cooling air flow, by which the front opening is closed.

The inner layer duct is provided with a cooler which cools down the cooling air in the inner layer duct to a predetermined temperature. Thus, the cooling air blown out from the outlet prevents the outer air from entering through the opening and at the same time cools down the display room. On the other hand, the outer layer duct is not provided with a cooler, but the protection air curtain formed with the protection air is positioned outside of the cooling air curtain formed with the cooling air, and protects the cooling air curtain while preventing the outer air from entering the display room.

Referring to FIG. 4, a conventional open showcase 100 is explained below. FIG. 4 is an enlarged longitudinal cross sectional side view of the top edge portion of an opening 109 of the conventional open showcase 100. A heat insulating wall 101 opened at its front is provided, and a partition wall 102 is provided inside the heat insulating wall 101 to form an outer layer duct 103 between the heat insulating wall 101 and the partition wall 102. An inner wall 104 is provided inside the partition wall 102 to form an inner layer duct 106 between the partition wall 102 and the inner wall 104.

The inner layer duct 104 is provided with a cooler and an air blower and the cooling air passing through the cooler flows therethrough. The outer layer duct 103 is not provided with a cooler and is provided with an air blower only, and the protection air blows therethrough. The heat insulating wall 101 has an outer layer outlet 107 formed at the front side of the top edge of the opening and the outer layer outlet 107 communicates with the outer layer duct 103. An inner layer outlet 108 is formed at the back of the outer layer outlet 107 and the inner layer outlet 108 communicates with the inner layer duct 106. To the outlets 107 and 108, honeycomb materials for air blow arrangement (not shown) are mounted.

Thus, the cooling air in the inner layer duct 106 blows out of the inner layer outlet 108 and forms the inner cooling air curtain and the protection air in the outer layer duct 103 blows out of the outer layer outlet 107 and forms the outer protection air curtain. Thus, a dual air curtain is formed at the front opening of the heat insulating wall 101.

The outlets 107 and 107 above are partitioned to the front part and the back part with a partitioning member 110. The lower front part of the partitioning member 110 is formed with an inclination inward and serves as an arrangement plate to direct the protection air from the outer layer outlet 107 inward or toward the display room.

In the above-mentioned case, the partitioning member 110 partitioning the outlets 107 and 108 is applied to the bottom of the front part 102A of the partition wall 102 and fixed with a screw 111. However, the front part 102A of the partition wall 102 may be wavy due to poor forming or deformation in the assembly process. In particular, the partition wall 102 is formed with a single steel plate material longitudinally from the right to the left of the front opening and is vulnerable to deformation during the assembly process. There is a drawback that a gap may be formed between the partitioning member 101 and the front part 102A of the partition wall 102.

Therefore, there is a drawback that the cooling air rising in the inner layer duct 106 may leak out of the gap between the front part 102A of the partition wall 102 and the partitioning member 110 to the outer layer duct 103. With the cooling air flowing toward the outer layer duct 103, the cooling air blown out of the inner layer outlet 108 decreases and the cooling air curtain is disturbed. This causes improper closing of the front opening of the display room with the cooling air curtain. The display room may be cooled poorly or cooling of the front face of the partitioning member 110 may result in dewing.

To settle the above-mentioned drawbacks, a sealer 112 is applied between the partitioning member 110 and the bottom of the front part 102A of the partition wall 102 as shown in FIG. 5 in the conventional showcase. However, this cannot effectively close the gap formed between the partition wall 102 and the partitioning board 110 and the cooling air rising in the inner layer duct 106 leaks out toward the outer layer duct 103 from the gap between the front part 102A of the partition wall 102 and the partitioning member 110.

Therefore, in case of an open showcase disclosed in the patent document 1, the partitioning member 110 is provided with a heater to suppress dewing occurring at the front of the partitioning member 110 when it is cooled by the cooling air leaking out of the gap.

With this configuration, a heating means is provided at the cooling air blowing part and there are problems of heat efficiency and complicated wiring connection. Furthermore, increase in the number of parts results in a higher cost.

SUMMARY OF THE INVENTION

The present invention has been made to solve the technical problems in the prior art, and provides an open showcase which enables elimination of the drawback that the cooling air rising in the inner layer duct leaks out toward the outer layer outlet from a gap between the partitioning member and the partition wall.

An open showcase, according to a first aspect of the present invention, comprises a heat insulating wall having an opening at a front thereof, an inner wall disposed in the heat insulating wall, a partition wall provided between the inner wall and the heat insulating wall to form an outer layer duct between the heat insulating wall and the partition wall and an inner layer duct between the partition wall and the inner wall, and an outer layer outlet and an inner layer outlet provided in an upper edge of the opening in a back and forth relationship in communication with the outer layer duct and the inner layer duct, respectively, to form a dual air curtain by an outer protection air flow and an inner cooling air flow, the open showcase comprising a partitioning member arranged between the outer layer outlet and the inner layer outlet, and mounted to the partition wall to extend downward from the partition wall, and an upstanding wall formed by folding a front edge of the partition wall, wherein the partitioning member has an engagement part to be engaged with a top edge of the upstanding wall from the front side and a fixing part closely contacting a bottom surface of the front part of the partition wall continuing to the upstanding wall in a state in which the engagement part is engaged with the top edge of the upstanding wall, and the fixing part is fixed to the partition wall by a predetermined fixing member by a fixing member in a state in which the fixing part closely contacts the partition wall.

According to a second aspect of the present invention, in the open showcase, the rear end of the fixing part has a shape to bite into the bottom surface of the partition wall.

According to the present invention, it becomes possible to surely partition the outer layer outlet and the inner layer outlet by the partitioning member without forming any gap between the partition wall and the partitioning member, since the open showcase is constituted such that it comprises a heat insulating wall having an opening at a front thereof, an inner wall disposed in the heat insulating wall, a partition wall provided between the inner wall and the heat insulating wall to form an outer layer duct between the heat insulating wall and the partition wall and an inner layer duct between the partition wall and the inner wall, and an outer layer outlet and an inner layer outlet provided in an upper edge of the opening in a back and forth relationship in communication with the outer layer duct and the inner layer duct, respectively, to form a dual air curtain by an outer protection air flow and an inner cooling air flow, the open showcase comprising a partitioning member arranged between the outer layer outlet and the inner layer outlet, and mounted to the partition wall to extend downward from the partition wall, and an upstanding wall formed by folding a front edge of the partition wall, wherein the partitioning member has an engagement part to be engaged with a top edge of the upstanding wall from the front side and a fixing part closely contacting a bottom surface of the front part of the partition wall continuing to the upstanding wall in a state in which the engagement part is engaged with the top edge of the upstanding wall, and the fixing part is fixed to the partition wall by a predetermined fixing member by a fixing member in a state in which the fixing part closely contacts the partition wall.

This enables elimination of the drawback that the cooling air rising in the inner layer duct leaks out toward the outer layer outlet from a gap between the partitioning member and the partition wall. It becomes possible to blow out the cooling air rising in the inner layer duct properly from the inner layer outlet so that the front opening can be properly closed by the cooling air curtain, and poor cooling in the display room can be avoided.

Furthermore, the front surface of the partitioning member is cooled down, which enables prevention of dewing because the cooling air flow in the inner layer duct does not leak out from between the partitioning member and the partition wall to the outer layer outlet side.

According to a second aspect of the present invention, the close contact between the fixing part and the bottom surface of the partition wall is improved and it is possible to ensure the surer air-tight partitioning of the outer layer outlet and the inner layer outlet, since the open showcase is constituted such that the rear end of the fixing part has a shape biting into the bottom surface of the partition wall.

DETAILED DESCRIPTION OF THE PREFERRED EMBODIMENT

Figure 1:
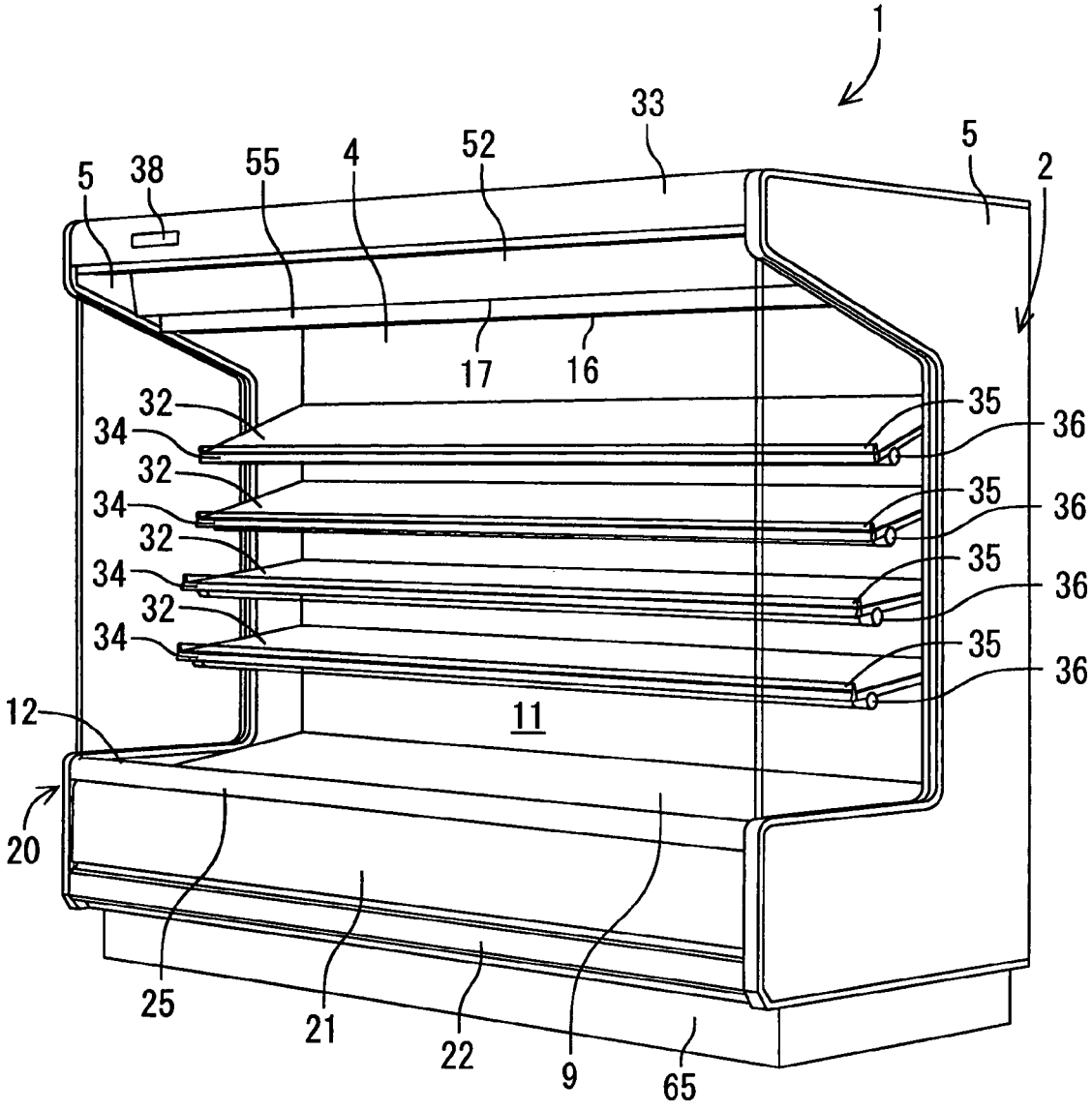
FIG. 1 is a perspective view of an open showcase according to the present invention.
Figure 2:
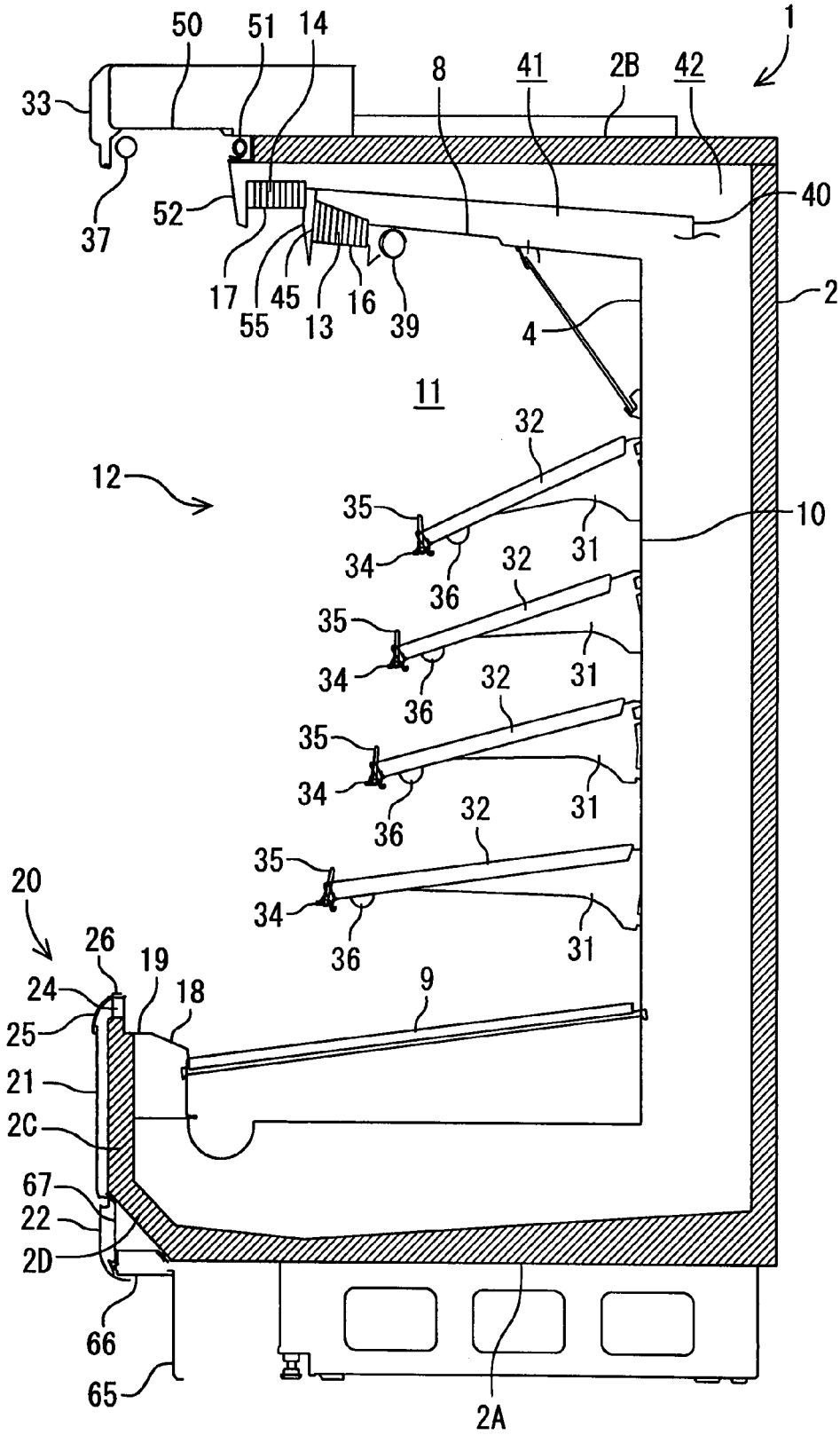
FIG. 2 is a longitudinal cross sectional side view of an open showcase in FIG. 1.

Next, referring to the accompanying drawings, an embodiment of the present invention is described in details below.

An open showcase 1 is, for example, a vertical open showcase installed in a supermarket or the like. An open showcase comprises a heat insulating wall 2 with a cross section substantially shaped like a square with its front side open and insulating side plates 5 and 5 mounted to the sides of the heat insulating wall 2 at the installation site.

An inner wall 4 is mounted at a predetermined distance inward from the heat insulating wall 2 of the open showcase 1, and a partition wall 40 is mounted at certain distances from the inner wall 4 and the heat insulating wall 2 respectively. An inner layer duct 41 is formed between the inner wall 4 and the partition wall 40 and an outer layer duct 42 is formed between the partition wall 40 and the heat insulating wall 2. At the front side of the lower end of a back inner wall 10 constituting the inner wall 4, a bottom plate 9 is mounted at a distance for duct from the bottom wall 2A of the heat insulating wall 2. The space defined by the inner wall 4 and the bottom plate 9 is used as a display room 11.

In the display room 11, a pair of brackets 31 whose height and the mounting angle can be changed is mounted to the pillar (not shown) at the back of the display room 11 together with a shelf plate 32 constituting a rack device with the brackets, and a plurality of such shelves are installed there. The shelf plate 32 is provided with a price rail 34 formed with hard synthetic resin at the front edge and the price rail 34 also serves as decoration of the shelf plate 32. In addition, a certain space is kept between the front wall of the shelf plate 32 and the price rail 34 and a guard 35 to prevent goods on the shelf plate 32 from falling is mounted at this space. At the lower front part of each shelf plate 32, a lamp 36 to illuminate the goods displayed on the shelf plate 32 below is disposed.

At the top edge of a front opening 12 of the heat insulating wall 2, an inner layer outlet 16 and an outer layer outlet 17 are laid out with honeycomb materials 13 and 14 mounted respectively. The inner layer outlet 16 and the outer layer outlet 17 communicate with the inner layer duct 41 and the outer layer duct 42 respectively. Note that the inner layer outlet 16 and the outer layer outlet 17 are, at the front end of the partition wall 40, defined and formed with a partitioning member 45. This configuration will be described in details later. On the other hand, at the bottom edge of the opening 12, an inner inlet 18 and an outer inlet 19 are laid out. A top inner wall 8 on the side of the display room 11 of the inner layer outlet 16 has a lamp 39 to illuminate the display room 11 from the top.

On one hand, a lower front wall 2C of the heat insulating wall 2 has a retreat part 2D at the bottom, which retreats to the front end of the bottom wall 2A. The retreat part 2D is formed continuously with the front end of the bottom wall 2A. The front wall 2C has, at the top, a handrail 20 consisting of a main handrail 24 mounted for the full width of the lower edge of the opening 12 of the showcase 1, an upper cover 26 to close the front glass holding groove provided in the main handrail 24 when the front glass is not set and a front upper panel 25 to cover the front side from the top end of the main handrail 24. A front lower panel 21 is mounted to the front of the front wall 2C continuously with the front upper panel 25 and a bumper 22 is mounted to the front of the retreat part 2D so that it becomes substantially flush with the front lower panel 21. The reference numeral 65 in the figure indicates a front panel provided at the lower part of the front end of the bottom wall 2A and the reference numeral 66 indicates a lower part holding plate to hold the bumper 22 to the front panel 65. The reference numeral 67 indicates a receiving metal positioned at the front of the retreat part 2D which supports the lower end of the front lower panel 21 and reinforces the bumper 22 and further serves for connection with the adjacent open showcase when several open showcases 1 of interest are laid out side by side.

On the other hand, a panel 33 is mounted at the front end of the top wall 2B of the heat insulating wall 2. On the inner side of the panel 33, a lamp reflector 50 to mount a lamp 37 is positioned at the back of the panel 33. This causes the inside of the display room 11 to be illuminated with the lamp 37 from the upper front part. In addition, an outlet outer wall 52 positioned at the front side of the outer layer outlet 17, which extends downward and closes the front end of the outer layer duct 42 is mounted at the front end of the top wall 2B of the heat insulating wall 2. Note that an engagement part (not shown) with the lower end folded backward is formed on the outlet outer wall 52 and it supports the front end of the honeycomb material 14 mounted to the outer layer outlet 17. At the top of the outlet outer wall 52, a winding type night cover 51 is accommodated at the front end of the top wall 2B of the heat insulating wall 2.

Figure 3:
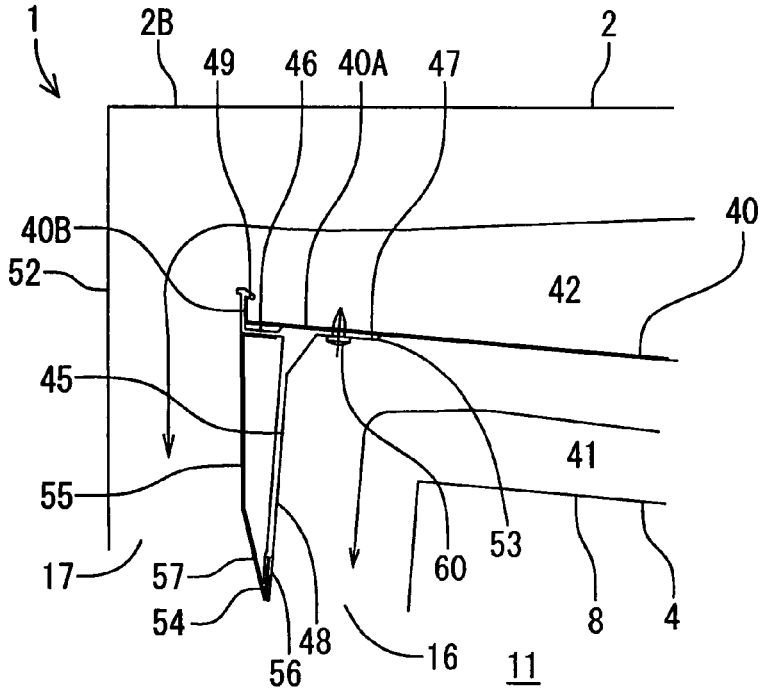
FIG. 3 is an enlarged longitudinal cross sectional side view of the top edge at an opening of the open showcase.
Figure 4:
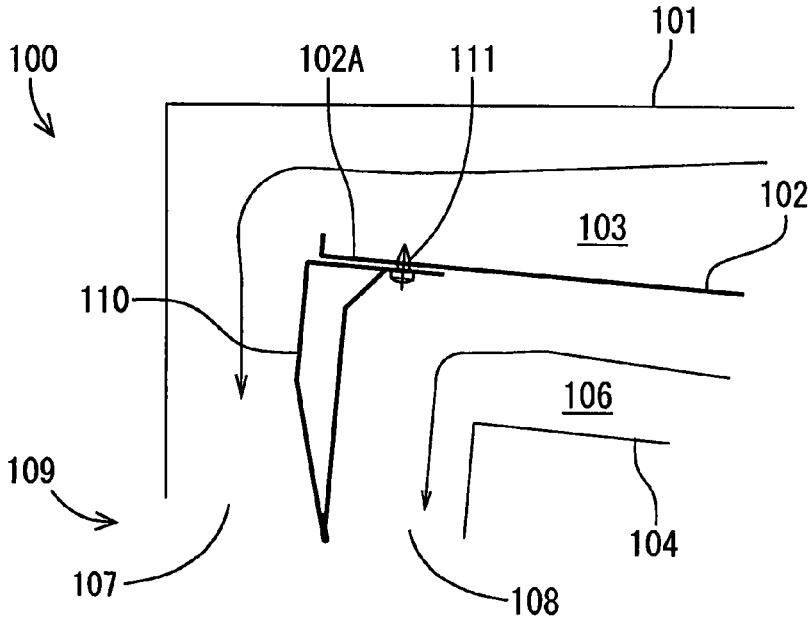
FIG. 4 is an enlarged longitudinal cross sectional side view of the top edge at an opening of a conventional open showcase.
Figure 5:
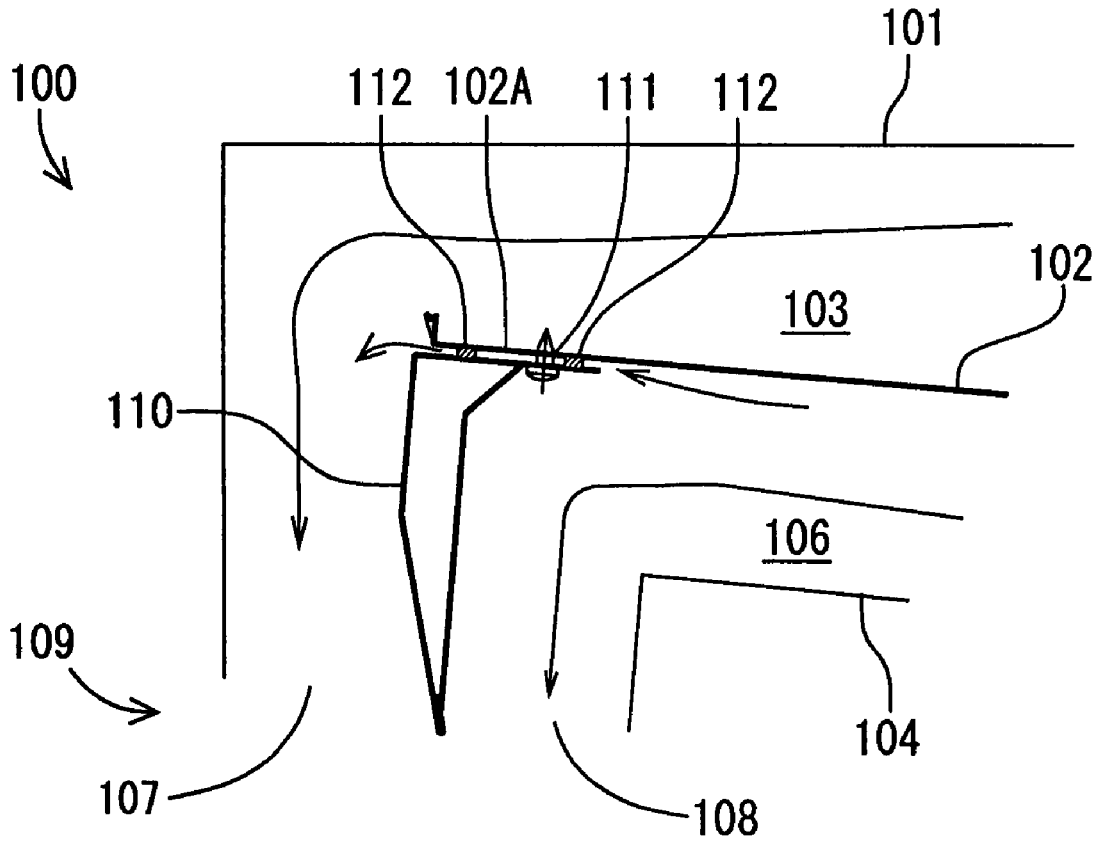
FIG. 5 is an enlarged longitudinal cross sectional side view of the top edge at an opening of a conventional open showcase.

Next, with reference to FIG. 3, the configuration of the partitioning member 45 defining and forming the inner layer outlet 16 and the outer layer outlet 17 as above will be described in details below. FIG. 3 is an enlarged longitudinal cross sectional side view of the top edge part of the opening 12 to illustrate the partitioning member 45. In the figure, the honeycomb materials 13 and 14 are omitted.

The partition wall 40 where the partitioning member 45 is mounted in this example defines and forms the inner layer duct 41 and the outer layer duct 42 between the heat insulating wall 2 and the inner wall 4 as described above. The side of the inner wall 4 on this partition wall 40 is used as the inner layer duct 41 and the side of the heat insulating wall 2 is used as the outer layer duct 42. An upstanding wall 40B folded upward substantially at a right angle is formed at the front end of the partition wall 40. The front part of the partition wall 40 is called a front part 40A.

The partitioning member 45 is a plate member formed with hard synthetic resin, which is integrally formed with a top wall 46 formed substantially along the bottom of the partition wall 40 and a partition wall 48 going down from the top wall 46.

The top wall 46 of the partitioning member 45 is of a substantially L-shaped cross section which substantially correspond the total shape of the upstanding wall 40B of the partition wall 40 formed at the front end thereof and the lower surface of the front part 40A continuing to it. An engagement part 49 is formed at the front top end of the top wall 46, protruding toward rear and below with a sharp angle. The rear part of the top wall 46 has a fixing part 47 provided with a fixing hole (not shown) formed for fixing it to the front part 40A of the partition wall 40 with a screw 60. Formed at the rear end of the fixing part 47 is a biting part 53 protruding upward with a slant toward the back in the direction of the partition wall 40.

At the lower end of the partition wall 48 of the partitioning member 45, an engagement groove (engagement part) 54 with a downward opening is formed. An engagement part 56 of an arrangement plate 55 is inserted in and held by the engagement groove 54, the arrangement plate 55 being positioned at the front of the partitioning member 45 to arrange the protection air from the outer layer duct 42. Here, the arrangement plate 55 is a plate member made of metal, in which its top end is folded backward in the substantially L-shaped cross section and its lower part is formed as an inclined surface 57 formed with an inclination for a certain angle backward. At the bottom end of the inclined surface 57, the engagement part 56 as described above is formed and folded backward.

When the partitioning member 45 is mounted to the front part 40A of the partition wall 40 in this configuration, the engagement part 49 of the partitioning member 45 is firstly engaged with the top edge of the upstanding wall 40B of the partition wall 40. Then, it is rotated backward around the contact part, so that the top wall 46 closely contacts the bottom surface of the front part 40A of the partition wall 40. Since the engagement part 49 is engaged with the top edge of the upstanding wall 40B of the partition wall 40 under this situation, the fixing part 47 can be easily fixed to the front part 40A with the screw 60 from the bottom.

Under this situation, the fixing part 47 closely contacts the bottom surface of the front part 40A of the partition wall 40, and this causes the front part of the top wall 46 to closely contact the front surface of the upstanding wall 40B. Therefore, even if the front part 40A of the partition wall 40 is formed poorly or becomes wavy due to deformation in assembly process, the top wall 46 can be fixed to the bottom surface of the front part 40A closely. At that time, the biting part 53 protruding upward with a slant toward the back is formed in the direction of the partition wall 40 at the rear end of the fixing part 47 of the partitioning member 45 and the rear end of the fixing part 47 has a shape to bite into the bottom surface of the front part 40A of the partition wall 40 via the biting part 53 and the front part 40A and the rear end of the fixing part 47 are put together air-tightly without a gap.

Thus, the partitioning member 45 is stably fixed to the front part 40B of the partition wall 40. After that, the engagement part 56 of the arrangement plate 55 is inserted into the engagement groove 54 formed at the bottom end of the partitioning member 45 for engagement with it and the top face formed at the top end of the arrangement plate 55 is attached to the bottom of the top wall 46 of the partitioning member 45. Here, the upper front surface of the arrangement plate 55 becomes substantially flush with the front surface of the upper wall 46 of the partitioning member 45 closely in contact with the front face of the upstanding wall 40B.

At the lower rear part of the bottom plate 9, a plurality of blowers (not shown) are installed on the bottom wall 2A of the heat insulating wall 2 corresponding to each of the inner layer duct 41 and the outer layer duct 42.

In the inner layer duct 41 at the rear of the back inner wall 10, the cooler of the cooling unit (not shown) is vertically installed and, when the air blower corresponding to the inner layer duct 41 is operated the cooling air after heat exchange with the cooler is raised in the inner layer duct 41 and blown out from the inner layer outlet 16 toward the inner inlet 18. Then, the cooling air taken from the inner inlet 18 is accelerated again by the air blower above. Thus, the cooling air curtain is formed at the front opening 12.

On the other hand, when the air blower corresponding to the outer layer duct 42 is operated, the protection air in the outer layer duct 42 is raised in the outer layer duct 42 and blown out from the outer layer outlet 17 toward the outer inlet 19. Then, the air taken from the outer inlet 19 is accelerated again by the air blower above. Thus, the protection air curtain is formed outside of the cooling air curtain at the front opening 12, and the opening 12 has a dual air curtain (with front and back curtains) formed. A part of the inner cooling air curtain is circulated in the display room 11, which is cooled down.

In this case, the partitioning member 45 partitioning the inner layer outlet 16 and the outer layer outlet 17 has the top wall 46 where the fixing part 47 is formed as described above is closely in contact with the front part 40A of the partition wall 40, which defines and forms the inner layer duct 41 and the outer layer duct 42. Because the fixing part 47 is fixed to the bottom of the partition wall 40 with the screw 60, any gap is not formed between the partition wall 40 and the partitioning member 45. The partitioning member 45 securely defines the outer layer outlet 17 and the inner layer outlet 16.

This enables elimination of the drawback that the cooling air rising in the inner layer duct 41 leaks out from the space between the top wall 46 of the partitioning member 45 and the front part 40A of the partition wall 40 to the side of the outer layer outlet 17. Therefore, it becomes possible to appropriately blow out the cooling air rising in the inner layer duct 41 from the inner layer outlet 16 and the front opening 12 can be properly closed with the cooling air curtain. Thus, poor cooling in the display room 11 can be avoided.

Furthermore, because the cooling air in the inner layer duct 41 does not leak out from the space between the top wall 46 of the partitioning member 45 and the front part 40A of the partition wall 40 to the side of the outer layer outlet 17, it becomes possible to avoid dewing caused by cooling of the front face of the partitioning member 45.

In particular, in case of the partitioning member 45 in this example, the front face of the upstanding wall 40B of the partition wall 40 formed upright at the front end is closely mounted to the rear face of the top wall 46 and, at the same time, the fixing part 47 formed at the rear part of the top wall 46 is closely mounted to the bottom of the front part 40A of the partition wall 40. Thus, the configuration without any gap between the bottom of the partition wall 40 and the top wall 46 of the partitioning member 45 can be achieved.

Furthermore, an encroaching part 53 with a shape biting into the bottom surface of the partition wall 40 is formed at the rear end of the fixing part 47 of the partitioning member 45. This can improve close adherence between the fixing part 47 and the bottom of the partition wall 40, and the outer layer outlet 17 and the inner layer outlet 16 can be air-tightly partitioned more securely. Thus, invasion of the cooling air from between the bottom of the partition wall 40 and the top wall 46 of the partitioning member 45 can be surely avoided.

The partitioning member 45 according to this example is, as described above, formed with hard synthetic resin and has an insulating property. With the partitioning member 45, the outer layer outlet 17 and the inner layer outlet 16 can be effectively insulated.

What is claimed is:

1. An open showcase having a heat insulating wall having an opening at a front thereof, an inner wall disposed in the heat insulating wall, a first partition wall provided between said inner wall and said heat insulating wall to form an outer layer duct between said heat insulating wall and said first partition wall and an inner layer duct between said first partition wall and said inner wall, and an outer layer outlet and an inner layer outlet provided in an upper edge of said opening in a back and forth relationship in communication with said outer layer duct and the inner layer duct, respectively, to form a dual air curtain by an outer protection air flow and an inner cooling air flow, said open showcase comprising:

a partitioning member arranged between said outer layer outlet and said inner layer outlet, and mounted to said first partition wall to extend downward from said first partition wall, said partitioning member being a plate member formed with hard synthetic resin, which is integrally formed with a top wall formed substantially along a bottom of said first partition wall and a second partition wall going down from said top wall;

an upstanding wall formed by folding a front edge of said first partition wall upward substantially at a right angle, wherein said top wall of said partitioning member has a substantially L-shaped cross section which substantially corresponds to a shape of said upstanding wall of said first partition wall and a bottom surface of a front part of said first partition wall continuing to said upstanding wall; and an arrangement plate, being a plate member formed of metal, is positioned at a front of said partitioning member, wherein said arrangement plate has a top end folded backward in a substantially L-shaped cross section and a lower part formed as an inclined surface formed with an inclination for a predetermined angle backward, wherein said arrangement plate forms a first engagement part;

wherein said partitioning member has a second engagement part, formed at a front top end of said top wall, protruding toward rear and below with a sharp angle, to be engaged with a top edge of said upstanding wall from a front side and a fixing part closely contacting said bottom surface of said front part of said first partition wall continuing to said upstanding wall in a state in which said engagement part is engaged with the top edge of said upstanding wall, and said fixing part is fixed to said first partition wall by a predetermined fixing member in a state in which said fixing part closely contacts said first partition wall, wherein an engagement groove is formed at a lower end of said second partition wall, said engagement groove having a downward opening, wherein said first engagement part is in said engagement groove and is held by said engagement groove.

2. The open showcase according to claim 1, wherein a rear end of said fixing part has a shape to bite into the bottom surface of said partition wall.

* * * * *